United States Patent [19]

Zioni et al.

[11] 3,980,980

[45] Sept. 14, 1976

[54] SWITCHING DEVICE

[75] Inventors: Dov Zioni; Levi Halperin, both of Jerusalem, Israel

[73] Assignee: Shaare Zedek Hospital, Jerusalem, Israel

[22] Filed: July 11, 1974

[21] Appl. No.: 487,770

[30] Foreign Application Priority Data

Aug. 22, 1973 Israel ..... 43049

[52] U.S. Cl. ..... 335/205; 250/229; 335/151

[51] Int. Cl.[2] ..... H01H 36/00

[58] Field of Search ..... 250/229, 551; 335/205, 335/171, 61, 153, 151

[56] References Cited

UNITED STATES PATENTS

| | | | |
|---|---|---|---|
| 2,057,380 | 10/1936 | Keefe | 335/171 |
| 3,071,664 | 1/1963 | Priesemuth | 335/61 |
| 3,336,482 | 8/1967 | Mierendorf et al. | 250/229 |
| 3,535,664 | 10/1970 | Staar | 335/153 |
| 3,579,159 | 5/1971 | Posey | 335/205 |
| 3,783,274 | 1/1974 | Towne et al. | 250/229 |

FOREIGN PATENTS OR APPLICATIONS

| | | | |
|---|---|---|---|
| 1,098,378 | 1/1968 | United Kingdom | 335/205 |

*Primary Examiner*—Harold Broome
*Attorney, Agent, or Firm*—Anthony J. Casella

[57] ABSTRACT

A switching device for the indirect activation and/or termination of systems operatively coupled to the switching device includes a manipulating member, an impulsing means, a circuit completion means adapted to be activated by said impulsing means, and a displaceable shielding means. The members are arranged such that upon manipulation of the manipulating member, the shielding means is displaced whereby the circuit completion means causes activation of the external system to which the device is wired.

16 Claims, 8 Drawing Figures

SWITCHING DEVICE

BACKGROUND OF THE INVENTION

The present invention relates to a switching device and more particularly to an indirectly activated electronic or electrical switching device for the indirect activation and/or termination of systems operatively coupled to the switching device.

The switching device of the invention is designed to inherently be useful for at least one of the four hereinafter described main general applications:

1. To provide a final activation and/or termination of a system, e.g., the closing of an electrical circuit or the starting of a machine, which is not a direct result of an initial activation such as the pressing of a pushbutton;
2. To provide initial activation means, e.g., a pushbutton, which is purely mechanically operated and momentarily manipulated by the operator whereas the final activation is precontrolled in terms of starting time, duration etc.,
3. To provide automatic reset into the initial condition of the device for a possible new activation operation; and
4. To electrically and/or electromagnetically isolate the initial activation means e.g., said pushbuttom, from a direct contact or the direct influence of any current carrying element of the device.

Furthermore, the present invention provides a solution to the activation of certain operations involving electronic or electrical power activation on the Jewish Sabbath and Festivals. Within the context of Halacha (Jewish Religious Law), direct activation of such operations would generally be prohibited. By means of the switching device of the present invention this activation is achieved by what would be considered as indirect action, which may be defined as "Grama" (causative) by Halacha, and which under Halacha principles falls within the categories of activity which is permitted in certain situations.

The possible applications of this switching device are numerous. To mention but a few examples of applications being considered to provide the solution of specific operational problems prevalent on the Jewish Sabbath and Festivals in hospitals and the like, are the following:

1. Activation and interruption of essential electric power;
2. Activation of emergency elevators;
3. Nurse call system in hospitals;
4. Activation of electro-medical apparatus.

SUMMARY OF THE INVENTION

Thus according to the present invention there is provided an indirectly activated electrical switching device comprising a manipulating member, an impulsing means, a circuit completion means adapted to be activated by said impulsing means and a displaceable shielding means for shielding said contact making means from the impulses produced by said impulsing means, the arrangement being such that upon the manipulation of said member the shielding means is displaced whereby said circuit completion means causes the activation of an external system to which it is wired.

The term impulsing means as used herein is intended to define any means adapted to periodically produce an effect which in the absence of the shielding means will result in the actuation of a circuit completion means to complete an electrical circuit. Thus said impulsing means can be a source of electromagnetic or light energy adapted to actuate, in the absence of a shield, a suitable circuit completion means such as a reed switch in the first instance and a photo-sensitive device in the latter instance, or said impulsing means can be mechanical or pneumatic in nature such as a periodically reciprocating contact actuating member.

In accordance to one embodiment of the invention the device is adapted to indirectly activate an external system to which it is wired whenever the shielding means are displaced to allow at least one of said impulses to reach said circuit completion means in order to actuate the latter. However, according to a further embodiment the device may just as well be adapted to indirectly activate an external system to which it is wired when at least one of the impulses does not reach the circuit completion means, e.g., whenever the shielding means is displaced to prevent at least one of said impulses from reaching the circuit completion means. This mode of operation, however, requires an additional circuit means, interconnected with said circuit completion means where the failure of at least one impulse to reach said circuit completion means will cause the emittance of an output signal which indirectly activates an external system to which it is wired.

BRIEF DESCRIPTION OF THE DRAWINGS

With specific reference now to the figures in detail it is stressed that the particulars shown are by way of example and for purposes of illustrative discussion of a preferred embodiment of the present invention only and are presented in the cause of providing what is believed to be the most useful and readily understood description of the principles and conceptual aspects of the invention. In this regard no attempt is made to show structural details of the system and its apparatus in more detail than is necessary for a fundamental understanding of the invention the description taken with the drawings making apparent to those skilled in the art how the several forms of the invention may be embodied in practice. In the drawings.

Figure 1:
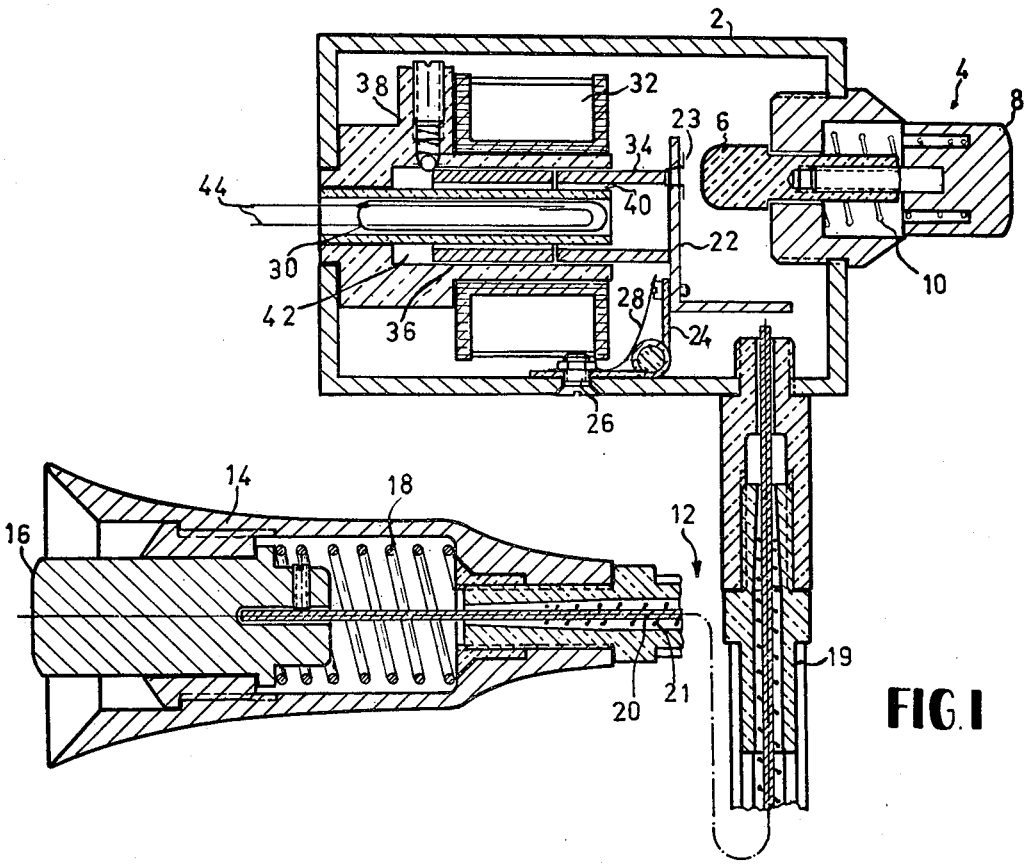
FIG. 1 is a cross-sectional view of a preferred embodiment of the switching device and of an optional remote activating member.
Figure 2:
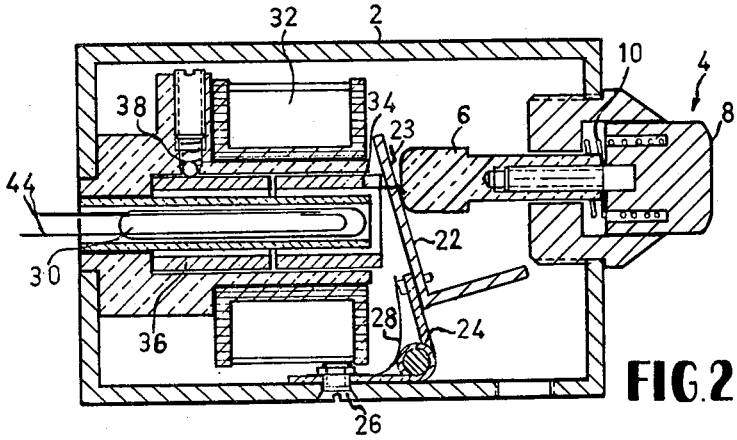
FIG. 2 is a cross-sectional view of the switching device of FIG. 1 showing the relative positions of the elements when the switch is activated.
Figure 3:
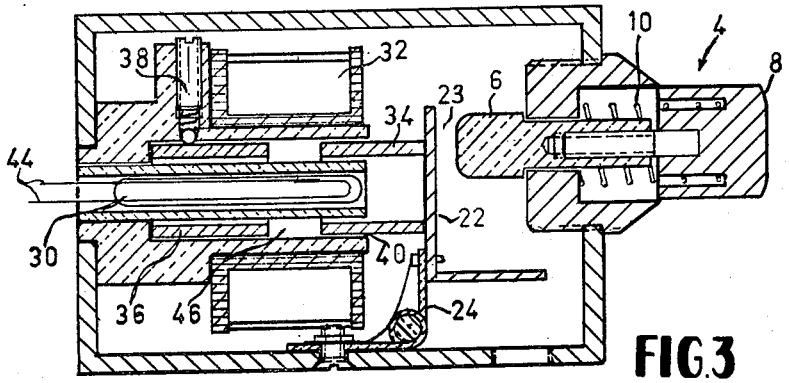
FIG. 3 is the same cross-sectional view as in FIGS. 1 and 2 showing the relative positions of the elements after activation.

The switching device according to the preferred embodiment of the invention shown in FIGS. 1 to 3 includes a housing 2, a spring loaded pushbutton 4 mounted in the housing, said pushbutton comprising a manipulating body 6 attached to a knob 8 which in turn is biased by means of a spring 10. Optionally, a remotely operated actuating member 12 comprising a handle 14, a pushbutton knob 16 biased by a spring 18 and operationally coupled to a flexible cable 19 having a central corewire 20 guided in a resilient spring wound core 21 may be also mounted in housing 2. This remotely operated actuating member is known in the art as a cable release, often used to release camera shutters and as it does not constitute part of the invention, need not be described herein in greater detail.

An L-shaped plate 22 is secured to hinge 24 which in turn is mounted at 26 to the housing 2. For a positive spring action of plate 22, a leaf spring 28, attached at one of its ends at 26 is provided so as to bias hinge 24 towards the pushbutton 4.

As further seen in these drawings, a normally open vacuum encapsulated reed switch 30 is axially disposed inside a coil 32 and is adapted to be activated by electromagnetic lines of force. Interposed between the reed switch 30 and the interior of the coil 32 are axially disposed sleeves 34 and 36 surrounding at least the major length of said reed switch and adapted to shield the switch from the electromagnetic lines of force by being made of any suitable high permeability metal. Sleeve 34 is secured to the plate 22 by means of a flexible wire or a retaining pin 23, while sleeve 36 is frictionally controlled by means of an adjustable spring loaded ball and screw arrangement 38. Both sleeves are adapted to reciprocate in an annular guiding channel 40 provided between the coil 32 and the reed switch 30.

This indirectly activated electrical switching device operates as follows:

Reed switch 30 is connected in circuit by means of leads 44 to the device to be indirectly and finally activated, deactivated or initiated when said switch is closed. The coil 32 is adapted to continuously receive electrical impulses at adjustable predetermined intervals and durations. The impulses are adjusted to generate in the coil a magnetic field of a sufficient strength to influence the reed switch 30, when it is not shielded by the sleeves 34 or 36. Furthermore, for reasons which will become apparent hereinafter, the normally open reed switch 30 is of the kind requiring a relatively weaker magnetic-field for sustaining it in its closed position, than the magnetic-field required in order to cause the closing of the switch; and the shields are of such a nature as to prevent the magnetic field from closing said switch while allowing a sufficient amount of flux to penetrate in order to sustain said switch in its closed position.

The depression of pushbuttons 8 or 16 causes the manipulating body 6 or the core-wire 20, respectively, to engage plate 22 and to impart to it an angular displacement to a position as seen in FIG. 2.

As is seen in FIG. 1, at its "set" or "ready" position, sleeve 34 bears against the vertical leg of the L-shaped plate 22, said sleeve partially extending outside the channel 40. Sleeve 36 abuts with one of its ends the end of sleeve 34 thus forming a continuous sheath around the major part of reed switch 30. In this rest position, the closed rear section 42 of the channel 40 is left unoccupied by sleeve 36. In this position, sleeve 36 is frictionally held in place by the spring loaded ball arrangement 38.

When plate 22 is caused to move by either body 6 or corewire 20, (see FIG. 2) it will bear against sleeve 34 and cause it to be axially displaced toward the inside of channel 40 while slidingly pushing sleeve 36 towards the closed rear section 42 of the channel 40. The release of the depressed pushbutton 8 or 16 will allow plate 22, under the influence of the spring 28, to return to its initial "set" or "ready" position as shown in FIG. 3, pulling with it the attached sleeve 34. In this position a gap 46 is created between the end parts of sleeves 34 and 36. Also as seen in the Figure, sleeve 36 is frictionally held in its displaced position by the spring loaded ball arrangement 38.

As described hereinbefore, coil 32 is continuously provided with impulses having the capability of inducing a magnetic field of a sufficient strength to activate the reed switch, i.e., to close said switch. As long as the reed switch is magnetically shielded by the sleeves, FIGS. 1 and 2, no actuation of the switch can take place. However after the return of plate 22 and the linked sleeve 34 to their initial position, the gap 46 created between the sleeves allows the magnetic flux to reach the switch and to close it. The closing of the switch initiates the activation of the circuit to which it is wired.

Simultaneously with the closing of the switch, the magnetic flux will act also on the frictionally displaceable sleeve 36 to cause its movement towards sleeve 34 until it abuts against the latter, thus closing the gap 46 and reshielding the reed switch.

Due to the characteristics of the reed switch described hereinbefore the reed switch will remain in its closed position and be maintained in this state under the influence of some of the magnetic flux which still penetrates the shielding, until the impulses cease; said cessation of impulses even for a short duration, as when trains of impulses are used to activate the electromagnet, results in the reopening of the reed switch. Alternatively the impulses can be made to automatically stop even for a short duration, after a predetermined period, to enable the reed switch to reopen and be ready for its next activation; said predetermined period having been calculated to be sufficient to allow the activated circuit to which the reed switch is wired to carry out its required operation.

In the following Figures there are illustrated further embodiments and modifications of the switching device of the invention.

Figure 4:
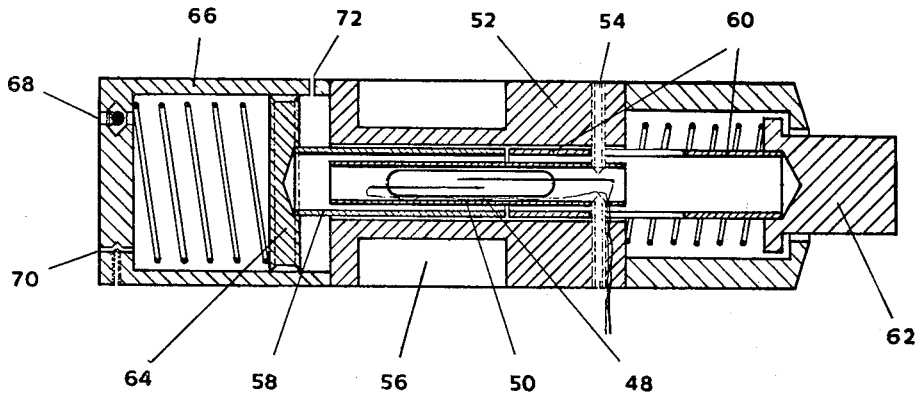
FIG. 4 is a cross-sectional view showing a further embodiment of the switching device having a pneumatic means for resetting said shielding means.

Turning first to FIG. 4, there is shown a switching device consisting of a reed switch 48 placed in a tubule 50 which is secured to the body of the switch 52 by means of two fastening screws 54. The reed switch 48 is adapted to be actuated electromagnetically by means of a coil 56 whenever a shielding sleeve 58 is displaced from inbetween the coil and the switch. Such a displacement is brought about by means of a second coaxial sleeve 60 whose farther end engages a spring biased push-button 62. The far end of sleeve 58 is secured to a spring loaded pneumatic piston 64. The piston is housed in an enclosure 66 having a unidirectional air valve 68, an adjustable air inlet 70 and an additional air aperature 72.

Similar to the operation of the switch illustrated in connection with FIGS. 1 to 3 the impulses produced by coil 56 do not affect the reed switch 48 as long as the ferromagnetic sleeve 58 shields said switch. However, when pushbutton 62 is depressed, sleeve 60 acts on sleeve 58 and displaces the latter from its position between the coil and the switch as well as displaces the piston 64 while expelling the air from the interior of the enclosure 66 via unidirectional air valve 68. An impulse impressed on the coil during the described displacement operation will not actuate the reed switch since the latter remains shielded by sleeve 60. The release of pushbutton 62 allows the immediate return of sleeve 60 to its original position while the return of sleeve 58 to its original shielding position is controllably delayed by the pneumatic piston 64. This controlled delay causes the forming of a gap between the two shielding sleeves and thus the reed switch is exposed to electromagnetic lines of force emanating from the coil. Thus, even when only one pulse is impressed on the coil during the time in which the reed switch is exposed, the latter will be closed and in turn will cause the external actuation of a system to which it is connected. It is clear that the delay time, namely, the return time of sleeve 58 to its original shielding position should be greater than the time interval between consecutive impulses applied to coil 56, in order to allow the electromagnetic energy to reach the reed switch.

Figure 5:
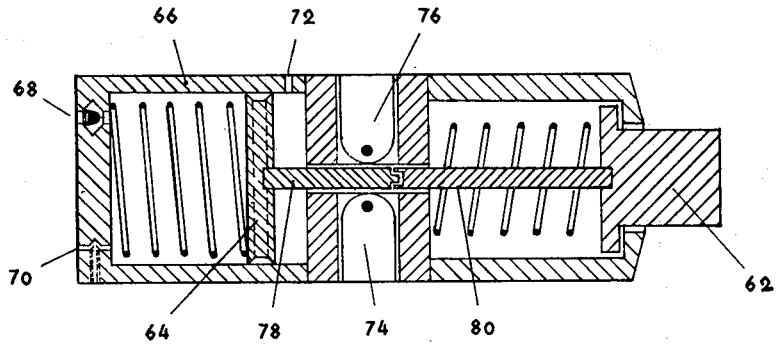
FIG. 5 is a cross-sectional view of a switching device according to the invention including a photosensitive device and pneumatic means for resetting said shielding means.

An indirectly activated electrical switch havng a photosensitive impulsing device is shown in FIG. 5. It consists of a light emitting diode (L.E.D.) or the like 74, and a photosensitive cell 76, such as a photo-diode or a photo-transistor.

Light emitting diode 74 and cell 76 are separated by an opaque element 78 attached to one of its ends to piston 64. Element 78 is adapted to be reciprocally displaceable from between diode 74 and cell 76 by means of a second element 80 attached to pushbutton 62 and said piston in the same manner as described hereinbefore in connection with FIG. 4.

Diode 74 continuously receives equally or unequally spaced pulses which cause a corresponding emittance of light. Thus, whenever a pulse of light reaches cell 76 the latter is activated and emits, in turn, a pulse which after being amplified, if needed, indirectly operates an external circuit to which it is wired.

Figure 6:
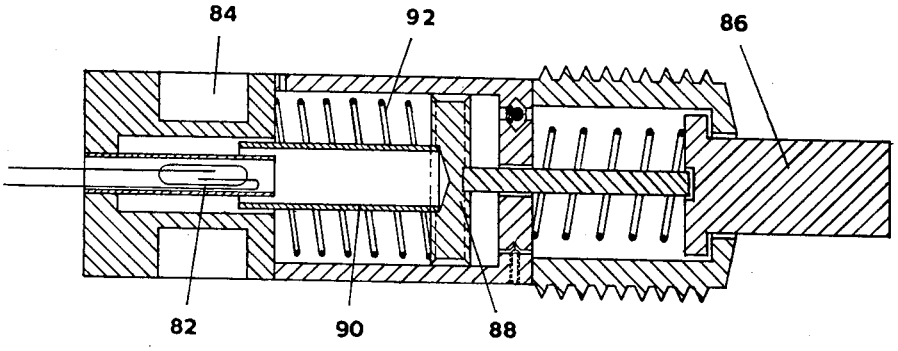
FIG. 6 is a cross-sectional view showing still a further embodiment of the switching device adapted to activate an external system upon the shielding of said circuit completion means.
Figure 7:
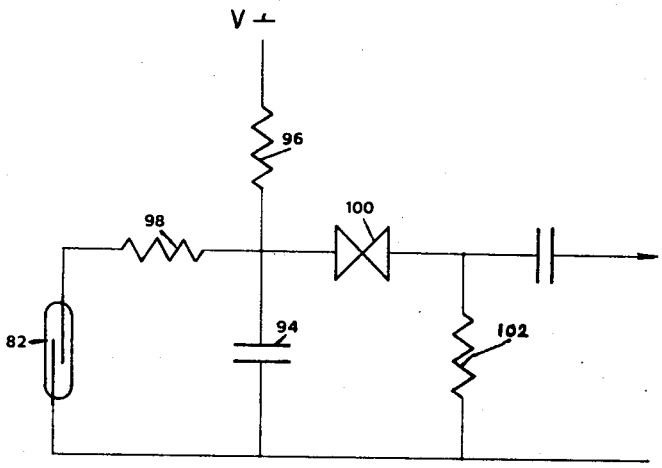
FIG. 7 is an electronic circuit diagram adapted to be connected to said switching device for obtaining an output signal when said circuit completion means is not activated.
Figure 8:
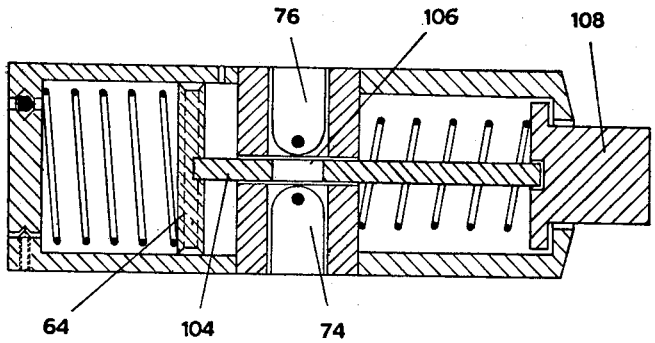
FIG. 8 is a cross-sectional view of the device of FIG. 5 but adapted to activate an external system upon the shielding of said photosensitive device.

FIGS. 6 to 8 illustrate further embodiments of the device which is adapted to indirectly activate an external system to which it is wired, when at least one of the continuous impulses does not reach the circuit completion means.

Referring first, to FIG. 6, there is shown a reed switch 82 adapted to be actuated by electromagnetic energy from coil 84, a spring biassed pushbutton 86 to which there is attached a pneumatic piston arrangement 88 similar to the arrangement of FIG. 4. The piston is also connected to a ferromagnetic shielding sleeve 90. As seen, in its normal state the reed switch 82 is exposed to the coil and is adapted to receive electromagnetic energy therefrom while the coil continuously received impulses. Upon pressing the pushbutton 86 the piston is displaced in the direction of the reed switch, compressing spring 92 while displacing sleeve 90 to its shielding position around said reed switch. The release of pushbutton 86 will allow the adjustably delayed return of the piston and sleeve to their original position. The return time of the piston is adjusted to be greater than the time between two consecutive impulses applied to the coil.

The above arrangement facilitates the indirect actuation of an external system whenever the reed switch does not receive the continuous electromagnetic contact making energy from the coil, i.e., Whenever the shielding sleeve is displaced by the pushbutton.

In FIG. 7 there is shown one possible embodiment of an electronic circuit to be connected to the reed switch to provide an external activating signal when at least one electromagnetic impulse is prevented from reaching the reed switch. As seen, capacitor 94 is charged through resistor 96 and whenever reed switch 82 closes, said capacitor discharges via resistor 98 having a much smaller resistor 96. When, however, reed switch 82 does not close, for example, when sleeve 90 assumes its shielding position, capacitor 94 continues to charge until it reaches the breakdown potential of the diac 100. The partial discharge of capacitor 94 via the conducting diac 100 will cause the desired signal for the indirect external activation of a system to appear on resistor 102.

The same circuit could also be used for the indirect external actuation of a system whenever at least one impulse from a series of continuous impulses is prevented from reaching a photosensitive device. In this case instead of the reed switch there will be connected said photosensitive device, e.g., photodiode or phototransistor.

The switch itself may be constructed, according to this embodiment as shown in FIG. 8. A plate 104 attached to the piston 64 is provided with a suitable slot 106 and is so positioned that in the unactuated state of the switch the slot 106 provides an opening through which continuous light impulses reach cell 76. Cell 76 which is wired in the circuit of FIG. 7 instead of the reed switch will cause capacitor 94 to discharge therethrough whenever a light impulse reaches it. When, however, pushbutton 108 is depressed, plate 104 is also displaced and the light emitted from diode 74 no longer reaches cell 76. Consequently, capacitor 94 (FIG. 7) does not discharge but rather continues to charge until the discharge potential of diac 100 is reached, causing in turn an activating signal to build up on resistor 102.

Upon the return of the pneumatic piston 64 to its original position, light emitted by diode 74 will again reach cell 76 causing the periodic discharge of the latter so that no external activating signal will be obtained until the next depression of pushbutton 108.

It should be clear that instead of the described pushbutton or wire-core actuating members, the switching device could just as well be actuated pneumatically by means of a syringe having a rubber bulb at one end thereof and a flexible tube attached to a manipulating body adapted to act on the L-shaped plate, or on the various sleeves, pistons or other activating elements in the various embodiments.

Also, the delay obtained by means of the described pneumatic piston could just as well be obtained by means of a hydraulic or oil filled piston or by means of a mechanically delayed spring arrangement.

Finally, it will be evident to those skilled in the art that the invention is not limited to the details of the foregoing illustrative embodiments and that the present invention may be embodied in other specific forms without departing from the spirit or essential attributes thereof, and it is therefore desired that the present embodiments be considered in all respects as illustrative and not restrictive, reference being made to the appended claims, rather than to the foregoing description, in which it is intended to claim all modifications coming within the scope and spirit of the invention.

What is claimed is:

1. An indirectly activated electrical switching device comprising manipulating member, an impulsing means, a circuit completion means adapted to be activated by said impulsing means and a displaceable shielding means shielding said circuit completion means from the impulses produced by said impulsing means, said manipulating member being moved from an initial position to a displaced position as a result of manual manipulation, and means to return said member automatically from its displaced position to its initial position, the arrangement of said member and said shielding means being such that upon manipulation of said member the shielding means is displaced and the circuit completion means is not actuated, and upon the automatic return of said manipulating member said circuit completion means is actuated to cause the activation of an external system.

2. The switching device as claimed in claim 1 wherein said impulsing means are adapted to provide electromagnetic impulses.

3. The switching device as claimed in claim 1 wherein said impulsing means are adapted to provide photoelectric impulses.

4. The switching device as claimed in claim 1 wherein said impulses are continuous pulses.

5. The switching device as claimed in claim 1 wherein said impulses are continuous trains of impulses.

6. The switching device as claimed in claim 1 wherein said circuit completion means is a magnetically actuated reed switch.

7. The switching device as claimed in claim 3 wherein said circuit completion means is a photosensitive device.

8. The switching device as claimed in claim 6 wherein said shielding means are two abutting sleeves surrounding said reed switch and adapted for reciprocal movement in an annular guiding channel concentrically surrounding the reed switch.

9. The switching device as claimed in claim 8 wherein at least one of said sleeves is made of a material providing magnetic shielding.

10. The switching device as claimed in claim 8 wherein at least one of said shielding means is adapted to be magnetically displaced in said guiding channel.

11. The switching device as claimed in claim 7 wherein said shielding means is an opaque plate adapted to shield said photosensitive device from said photoelectric impulses.

12. The switching device as claimed in claim 8 wherein at least one of said sleeves is abutted by a spring biased movable plate, said plate being adapted to move whenever the manipulating member is actuated so as to displace said sleeve in the guiding channel.

13. The switching device as claimed in claim 12 wherein said sleeve is linked to said plate.

14. The switching device as claimed in claim 8 wherein an adjustable friction applying means is provided adjacent at least one of said sleeves whereby the reciprocating movements of at least one of said sleeves is adapted to be frictionally controlled.

15. The switching device as claimed in claims 1 further comprising a spring loaded pneumatic piston arrangement, whereby said displaceable shielding means is adapted to return to its original position after being displaced.

16. An indirectly activated electrical switching device comprising a manipulating member, an impulsing means, a circuit completion means associated with circuit means, said circuit completion means being adapted to be activated by said impulsing means and a displaceable shielding means shielding said circuit completion means from the impulses produced by said impulsing means, said manipulating member being moved from an initial position to a displaced position as a result of manual manipulation, and means to return said member automatically from its displaced position to its initial position, the arrangement of said member and said shielding means being such that upon manipulation of said member the shielding means is displaced to shield the circuit completion means whereby after a preset delay time interval said shielding means is movable to allow actuation of the circuit means to provide an output signal.

* * * * *